US010472882B1

(12) United States Patent
Pettibone

(10) Patent No.: US 10,472,882 B1
(45) Date of Patent: Nov. 12, 2019

(54) MODULAR SUB-SILL UNIT

(71) Applicant: George E. Pettibone, Des Moines, WA (US)

(72) Inventor: George E. Pettibone, Des Moines, WA (US)

( * ) Notice: Subject to any disclaimer, the term of this patent is extended or adjusted under 35 U.S.C. 154(b) by 0 days.

(21) Appl. No.: 16/148,943

(22) Filed: Oct. 1, 2018

Related U.S. Application Data

(63) Continuation of application No. 14/877,714, filed on Oct. 7, 2015, now Pat. No. 10,087,678, which is a continuation-in-part of application No. 14/205,018, filed on Mar. 11, 2014, now abandoned.

(60) Provisional application No. 61/780,837, filed on Mar. 13, 2013.

(51) Int. Cl.
*E06B 7/14* (2006.01)
*E06B 1/70* (2006.01)

(52) U.S. Cl.
CPC ..... *E06B 7/14* (2013.01); *E06B 1/702* (2013.01)

(58) Field of Classification Search
CPC ..... E06B 1/702; E06B 7/14
See application file for complete search history.

(56) References Cited

U.S. PATENT DOCUMENTS 2,129,381 A 9/1938 Oftedal
2,827,674 A 7/1954 Hauck
3,410,027 A * 11/1968 Bates ..... E06B 7/14 49/471
3,503,169 A 3/1970 Johnson
3,570,182 A 3/1971 Bakke
4,310,991 A 1/1982 Seely
4,691,487 A * 9/1987 Kessler ..... E06B 7/14 137/527.8
5,123,212 A 6/1992 Dallaire
5,179,804 A 1/1993 Young
5,746,032 A 5/1998 Koike
5,921,038 A * 7/1999 Burroughs ..... E06B 7/14 49/408
6,334,283 B1 1/2002 Edger
6,371,188 B1 * 4/2002 Baczuk ..... E06B 1/70 160/92
6,374,557 B1 4/2002 O'Donnell
7,263,808 B2 9/2007 Massey
7,669,369 B2 3/2010 Henry
8,353,138 B2 1/2013 Sigmund
9,062,490 B2 6/2015 Kadavy
(Continued)

*Primary Examiner* — Andrew J Triggs
(74) *Attorney, Agent, or Firm* — Knobbe, Martens, Olson & Bear, LLP

(57) ABSTRACT

A modular sub-sill unit to provide improved water drainage is attachable to a bottom part of a sill and to a portion of an exterior wall that corresponds to the bottom of an opening, such as a door, window, or skylight. The sub-sill unit may include a top plate, which provides a plurality of weep holes that allow liquid to pass through and be deposited on an inner deflection wall. The inner deflection wall deflects the liquid into a water trough or channel, which extends across the length of the sub-sill unit at a front edge facing outwardly from the exterior wall. The liquid then exits through a plurality of exit holes in the outer front edge. The inner deflection wall thus creates a dry zone that prevents the liquid from reaching a base plate and protects the fasteners that attach the base plate to the exterior wall.

18 Claims, 14 Drawing Sheets

(56) References Cited

U.S. PATENT DOCUMENTS

| | | | | |
|---|---|---|---|---|
| 9,556,668 | B2 | 1/2017 | Kandacy | |
| 9,863,183 | B2 | 1/2018 | Johnson | |
| 10,087,678 | B2 * | 10/2018 | Pettibone | E06B 7/14 |
| 2012/0005975 | A1 | 1/2012 | Kim | |
| 2014/0260011 | A1 * | 9/2014 | Pettibone | E06B 7/14 52/209 |
| 2016/0053529 | A1 * | 2/2016 | Pettibone | E06B 1/702 52/209 |

* cited by examiner

MODULAR SUB-SILL UNIT

INCORPORATION BY REFERENCE TO ANY PRIORITY APPLICATIONS

This U.S. Patent Application is a continuation of U.S. patent application Ser. No. 14/877,714 filed Oct. 7, 2015, which is a continuation-in-part of U.S. patent application Ser. No. 14/205,018 filed Mar. 11, 2014, which claims the priority filing date of U.S. Provisional Application Ser. No. 61/780,837 filed on Mar. 13, 2013, the contents of each of which are herein incorporated by reference in their entirety.

BACKGROUND OF THE INVENTION

Window sill systems in current use have basic flaws, including but not limited to the following:

Sheet metal, plastic, rubber or synthetic membrane, stainless steel sheets, aluminum extrusions, must be fastened to the building by some mechanical form, such as screws or bolts, nails or all threaded rods.

Most of these fasteners end up in what is referred to as the "wet-zone" which where we expect to capture some amount of moisture/water and keep it from entering the building envelope. Holes are drilled in these conventional window sill flashings for these fasteners. Sealant is normally applied to the head of fasteners to try to keep surroundings standing water from seeping through the holes and into the building substrate. Expansion and contraction, heat and cold temperatures, building movement, building sway, water laying in the sill system for a prolonged time stressed and loads from the window system, wind loads called together to cause leakage of water into the building.

The fasteners, of thousands of different brands, types, sizes, materials, widths, of window doors, or other exterior materials to or through metal sill flashings has a long history of failure. This is because the concept has built in flaws in its concept.

End dams are now being used and considered normal for the last twenty years or so. They are commonly just a piece of metal, flat or 90 degree angle shape, installed with sealant and or screws. These are to keep water from leaking through the right and left ends of the sill flashing. Unfortunately many installers did not think they were needed and never installed them.

The normal sill cannot be used for fastening the window down to achieve real anchorage. Fasteners must go through the window sill, and penetrate the sill flashing, then several inches into a concrete floor or wall for instance, to gain a real sound anchorage to the building structure.

Water is widely recognized as being able to find its way into a window system, by all window manufactures. Weep holes have been around for over 65 years. Condensation can find its way into almost any window system. Negative pressure can be another water problem.

Windows must accommodate a minimum of (14) major design problems:

Wind load, wind pressure on positive plane.
Negative wind loads
Bending of framing materials
Deflection of glazing materials
Earthquakes
Water infiltration
Wind leakage, noise
Dead loading
Corrosion, coastal conditions, dissimilar metals Heat and ultra-violent degradation of paint finishes, plastic or PVC components or framing
Expansion and contraction
Uplift in major storm or hurricane
Marketability
Combinations of all of the above and more.

It is therefore deemed desirable to provide an improved window sill that would perform on a very large number of buildings, structural material, designs, wall conditions, window types, window brands, depth of window frames, weight of windows, width and height of window, single hung, double hung, jalousies, fixed, sliding casement, hopper, awning, louvered windows and such. It should also accommodate a very large number of doors to meet all of the above criteria. Doors could be of the type that swing in, swing out, singles or pairs, bi-folding doors, sliding patio doors, other sliding doors, vertical roll up, or slide up doors. The improved unit should also accommodate many other exterior forms of curtain wall, fenestrations, spandrel panels, decorative panels, stone veneer, louvers, sky lights and screened enclosures.

SUMMARY OF THE INVENTION

In accordance with the present invention, an improved window sill system has a modular bottom sub-sill unit to be attached to a bottom part of a window unit to be mounted within a window frame in an opening in an exterior wall of a building in order to provide improved water drainage for the window sill system. The bottom sub-sill unit has a water trough or channel extending across its length at a front edge facing outwardly of a window unit to which the sub-sill unit is mounted. The water trough or channel has a top plate provided with a plurality of weep holes for capturing rainwater dripping down the window into the water trough or channel. A base plate is provided for mounting the bottom sub-sill unit with fastener screws on a top surface of the bottom frame part of a surrounding window frame. An inner deflection wall deflects water from the weep holes into the water trough or channel to prevent water from reaching the fastener screws below the inner deflection wall.

Other objects, features, and advantages of the present invention will be explained in the following detailed description of preferred embodiments of the invention having reference to the appended drawings.

DETAILED DESCRIPTION OF THE PREFERRED EMBODIMENT

In the following detailed description of the invention, certain preferred embodiments are illustrated providing certain specific details of their implementation. However, it will be recognized by one skilled in the art that many other variations and modifications may be made given the disclosed principles of the invention.

Figure 1:
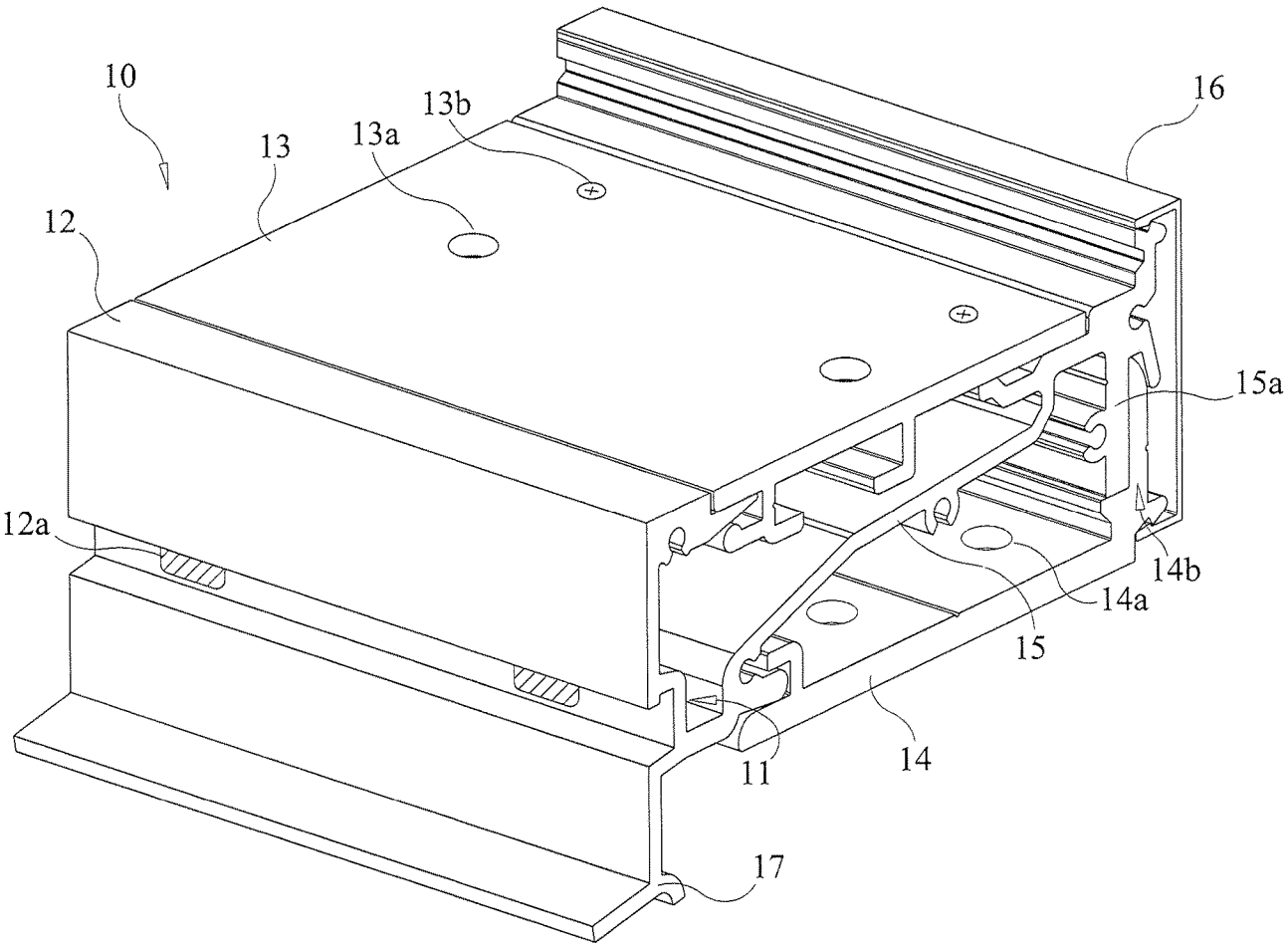
FIG. 1 shows an isometric sectional view of a preferred embodiment of a window sub-sill system in accordance with the present invention.

Referring to FIG. 1, an isometric sectional view of a preferred embodiment shows an improved window sill system having a modular bottom sub-sill unit 10 to be attached to a bottom part of a window unit and mounted on a bottom frame part of a window frame in an opening in an exterior wall of a building in order to provide improved water drainage for the window sill system. The window frame may be of a quadrangular frame type having a top frame part, bottom frame part, and opposite vertical side frame parts forming a rectangular opening for a window unit to be mounted therein. The bottom sub-sill unit 10 is shown having a water trough or channel 11 extending across its length at a front edge 12 facing outwardly of the bottom sub-sill unit 10. Opposite the water trough or channel 11 is a horizontally-extending top plate 13 provided with a plurality of weep holes 13*a* across a horizontal length thereof for capturing rainwater or condensation moisture seeping down the window unit installed in the window frame. The rainwater or moisture seeping into the weep holes 13*a* flows down the upper space and is captured in the water trough or channel 11 for draining water captured therein. A horizontally-extending base plate 14 is provided for mounting the bottom sub-sill unit 10 with fastener screws to the bottom frame part of the window frame (details shown in FIG. 9). An inner deflection wall 15 is provided for diverting moisture from the weep holes into the water trough or channel 11 so as to prevent moisture from reaching the fastener screws in a dry zone below the inner deflection wall.

The top plate 13 may be mounted by set screws 13*b* to an inner extension portion 15*a* of the inner deflection wall 15 on which the top plate is seated. A cover 16 may be snap-fitted onto the inner extension portion 15*a* of the inner deflection wall 15 to form an interior closure. A lower flashing 17 may be provided extending downwardly and outwardly from a lower portion of the front edge 12 below the exit holes 12*a* to deflect any dripping water away from the window frame and sill structures.

Figure 2:
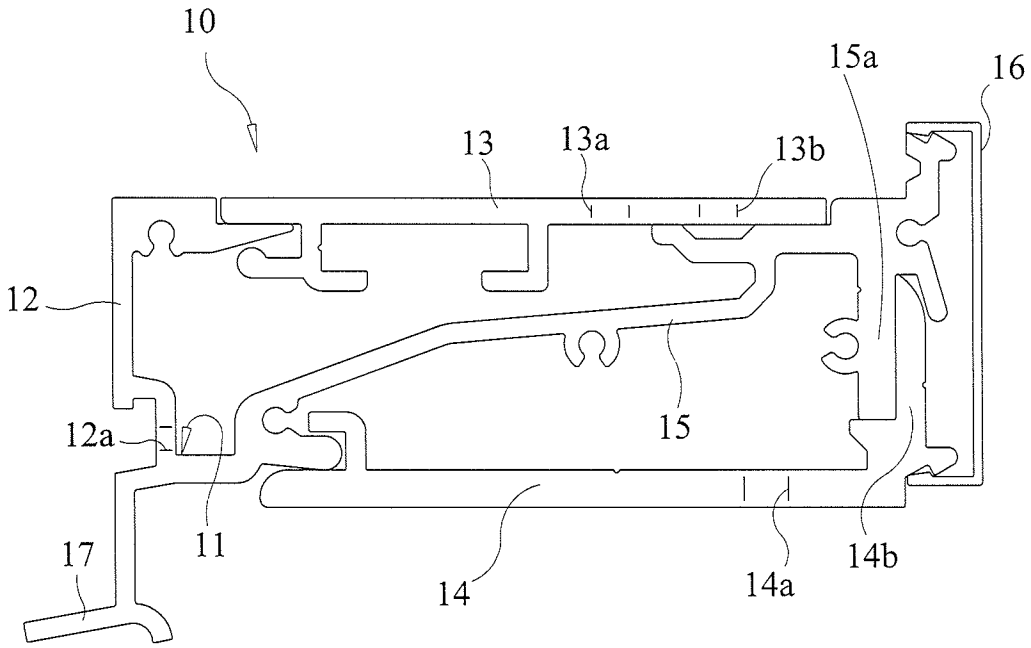
FIG. 2 shows a side sectional view of the bottom frame of the window sub-sill system.
Figure 3A:
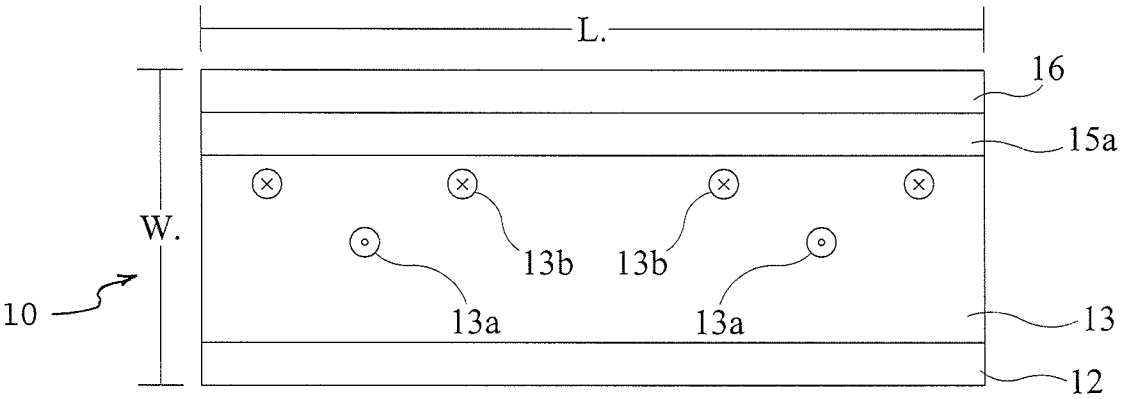
FIG. 3A shows a top view
Figure 3B:
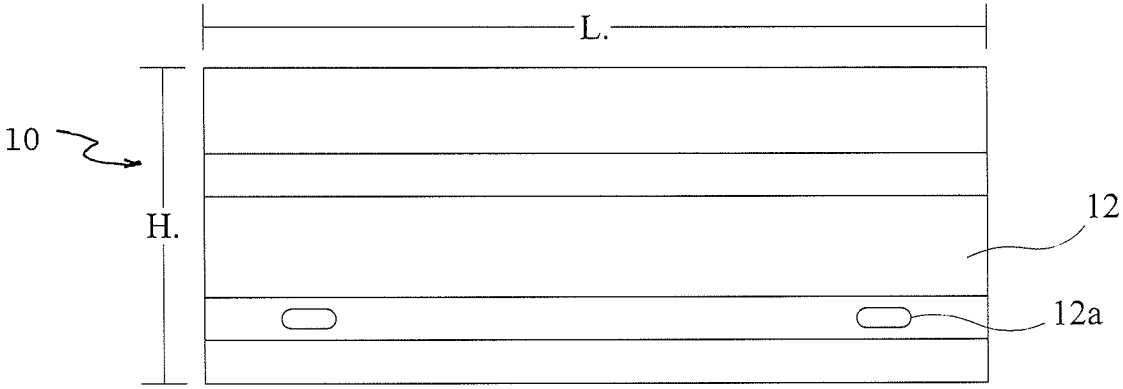
FIG. 3B shows an exterior elevation view of the window sub-sill system.
Figure 4A:
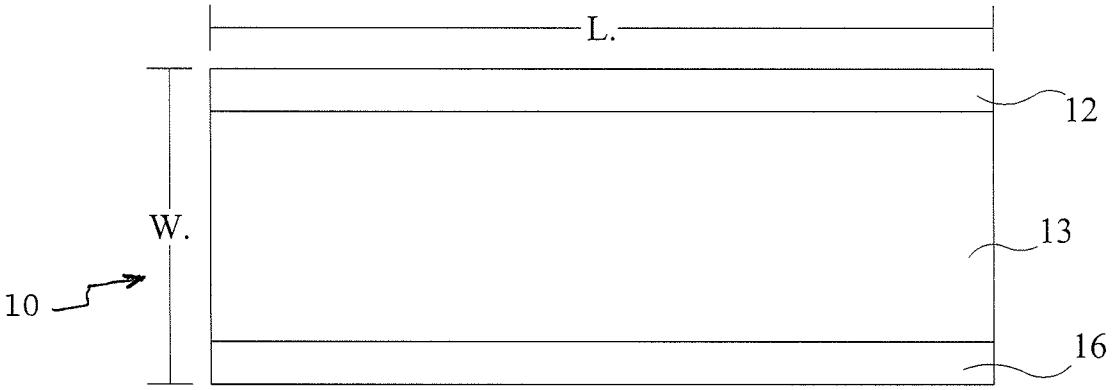
FIG. 4A shows a bottom view and FIG. 4B shows an interior elevation view of the window sub-sill system.
Figure 4B:
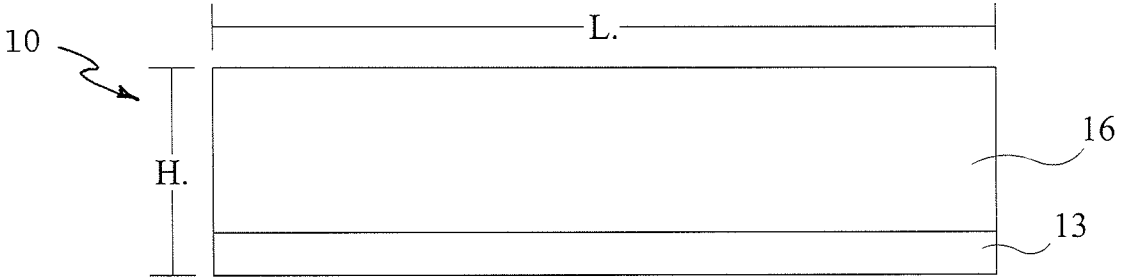
Figure 5:
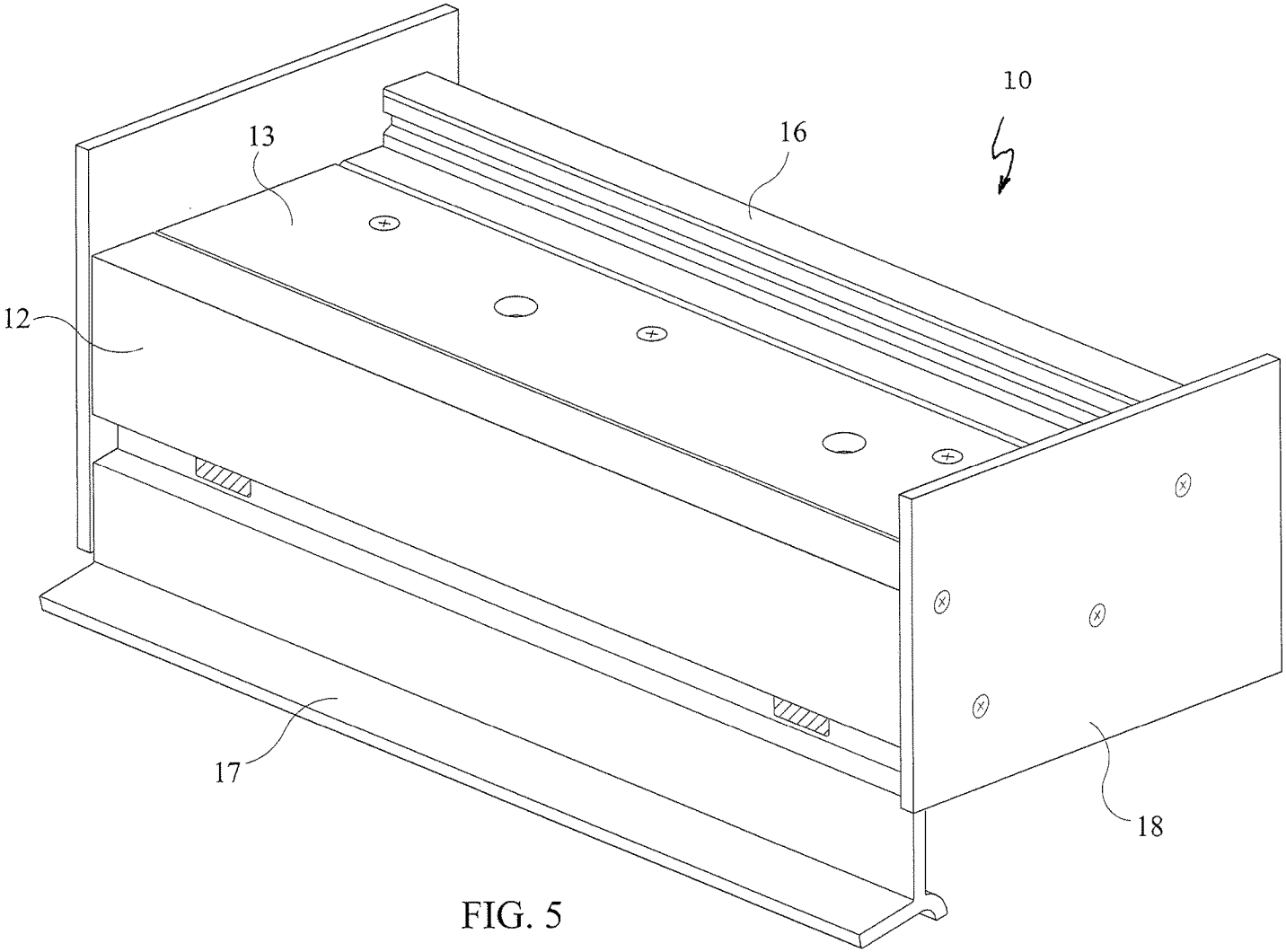
FIG. 5 shows an isometric view of the window sub-sill system with end dams attached to its opposite lateral ends.

FIG. 2 shows a side sectional view of the bottom sub-sill unit 10 of the improved window sub-sill system. FIG. 3A shows a top view and FIG. 3B shows an exterior elevation view of the bottom sub-sill unit 10 of the improved window sub-sill system. FIG. 4A shows a bottom view and FIG. 4B shows an interior elevation view of the bottom sub-sill unit 10 of the improved window sub-sill system. FIG. 5 shows the parts of the bottom sub-sill unit assembled together, with end dams 18 mounted on opposite lateral ends of the bottom sub-sill system for sealing off the lateral ends.

The improved window sill system with bottom sub-sill unit 10 is designed to be used with a wide variety of storefronts, windows, curtain wall, jalousies, louvers, etc., with permanent screwed in end caps or plates. As shown in the isometric external view of FIG. 5, the end dams 18 may generally be about 2" taller than the sub-sill system, and extend down near the bottom of the sub-sill system. The end dams extend the full depth of the window sub-sill system from inside to outside. Caulking may be applied to the end dams after they have been screwed onto the ends of the main exposed extrusion shape. The removable top plate 13 may be approximately 4" wide and allows for installation and inspection of the sealant. This creates more quality control.

The installation of weep holes 12*a* in the front edge 12 of the bottom sub-sill unit 10 is enhanced by installing baffle sponges. These open cell synthetic sponges which could be sized properly to fit in the bottom corner, water trough area would normally be approximately two inches long and installed from above the cavity with ease. The weep holes are designed to be drilled out or punched out. These weep holes should be somewhat elongated to be noticeable out of round or a true slot approximately twice as wide as tall to relieve a condition known as "surface water tension". Water in the sub-sill system, with little or no wind pressure, will resist or not flow out of an ⅛" diameter round weep hole set, nor a 3⁄16" or ¼" diameter round hole set. By drilling two holes, side by side, from the exterior, then working the ¼" drill bit to remove the small web between holes, it quickly becomes a horizontal slot, about 9⁄16" wide×¼" high. On a short window sill over 5 feet wide more weep holes would be needed, spaced approximately 24" O.C. typical.

The bottom sub-sill unit 10 can be formed in standard lengths and cut to size as needed for use with a wide range of window unit and window frame types. For example, the bottom sub-sill unit 10 may be formed in length increments up to 24 feet long approximately, as this is the range of normal limits for extruding, anodizing, shipping, boxing etc, in the commercial window business and the suppliers. Internal splice sleeves can be added if a project required longer, continuous runs of this system. Expansion and contraction can be accommodated in properly positioned, spaced and installed splice joints.

The bottom sub-sill unit 10 of the window sub-sill system is designed for maximum benefits, starting with its heavy-wall shape and thickness. Main parts are usually a ¼" thick to allow for large windows to dead load on top of it, large bottom surface for plastic shims as required by field conditions, the ability to be partly cantilevered on a narrow wall condition, maximum resistance to warping, bending or settling, or staggered placement or straight alignment of a series of fasteners to building structure. The use of bolts or all thread rod and epoxy, up to ⅝" diameter with washers and nuts, allowing for maximum attachment strength. These various options in fastener type, size and design are no longer sitting in a puddle of water, adding many years to the expected life cycle of the window sill, compared to manufactured systems currently on the market. The ¼" thick upturned leg offers maximum wind load resistance, both inward and outward, a positive alignment with the large external shaped box, with positive lock-in feature, as a series of #10 screws or ¼"×20 screws or size, is installed from inside the building envelope, approximately 24" on center. The dead load weight of the windows should cause the window sill exterior box to rest permanently and correctly upon the sill base. The screw heads are hidden from view by a snap-on interior cover.

The main exterior frame structure is built very strong, to handle heavy windows and a hurricane. The main cavity is going downhill all the way to the weep holes, therefore all water will drain out in a very rapid time. No water should ever get into the lower area where the structure fasteners occur. The weep holes on this extrusion have an eyebrow and set-back feature to help keep rainwater from entering the weep holes to a large extent. This main exposed box is built to accept the flat top cover plate shown in the drawings.

The top plate of the bottom sub-sill unit 10 is slid into place, to lock onto the exterior part of a window unit. Holes are drilled through the top plate, towards the rear area and screws are installed to lock down the back part of the plate. On some window conditions countersinking may be required. Drain holes approximately ⅜" in diameter are drilled through this flat plate to ensure that it causes water to promptly flow down into the sloping cavity below. In effect it becomes a "sieve" to perform as noted above. Holes could be 6-8" on center, and hidden by the window itself. The dual hooks hidden on the underside of this flat cover plate allows the user the option of sliding a piece of ¼"×1" aluminum bar stock or some in stainless steel, several inches long for enhanced attachment of a window above. The installer could fasten machine bolts or screws to resist in-outward movement as well as downward and uplift. This could be the cleanest and strongest attachment, with no real concerns about water leakage. The installer would run a bead of caulking in the corner of the window unit just below where the snap-on cover attaches near the top, which is very normal in the industry.

The range of complementary parts could be made to accommodate unusual conditions in various large buildings, and have all of these benefits. The flat plate is designed to leak; the rest of the system is designed to never leak. The recent adoption of "Hurricane Codes" in some states that did not previously have them require a window sill that should last 70-100 years, and multiple hurricane level storms, without failure. Superior positive drainage, thick walled extrusions, depth of system can be customized with some general arrangement of all design concepts. The window sub-sill system is designed to accommodate hundreds of different window frames or brands.

The 2-inch "water table" sill provides a unique structure. "Water table" is known in the window and door industry as the height of the inside leg of a frame compared to the exterior leg or part of the frame. Water will try to climb up and over the interior leg on any window system, if driven by the wind pressure and speed. There are multiple levels of performance, based certified water testing procedures. The heights of the inner leg on sills of commercial grade aluminum patio doors are greater than that of a less expensive residential patio door for instance. Caulking on the exterior is paramount to any window or fenestration product and installation. This custom sub-sill design offers a very professional application of the caulking and backer rod. Backer rod is common name for open or closed cell sponge (in a round shape normally) to stop the caulking from moving laterally into a cavity, so that it may be tooled as is common to the window fenestration business. Two-sided adhesion and proper depth-height ratio is readily achieved on this system.

Figure 6:
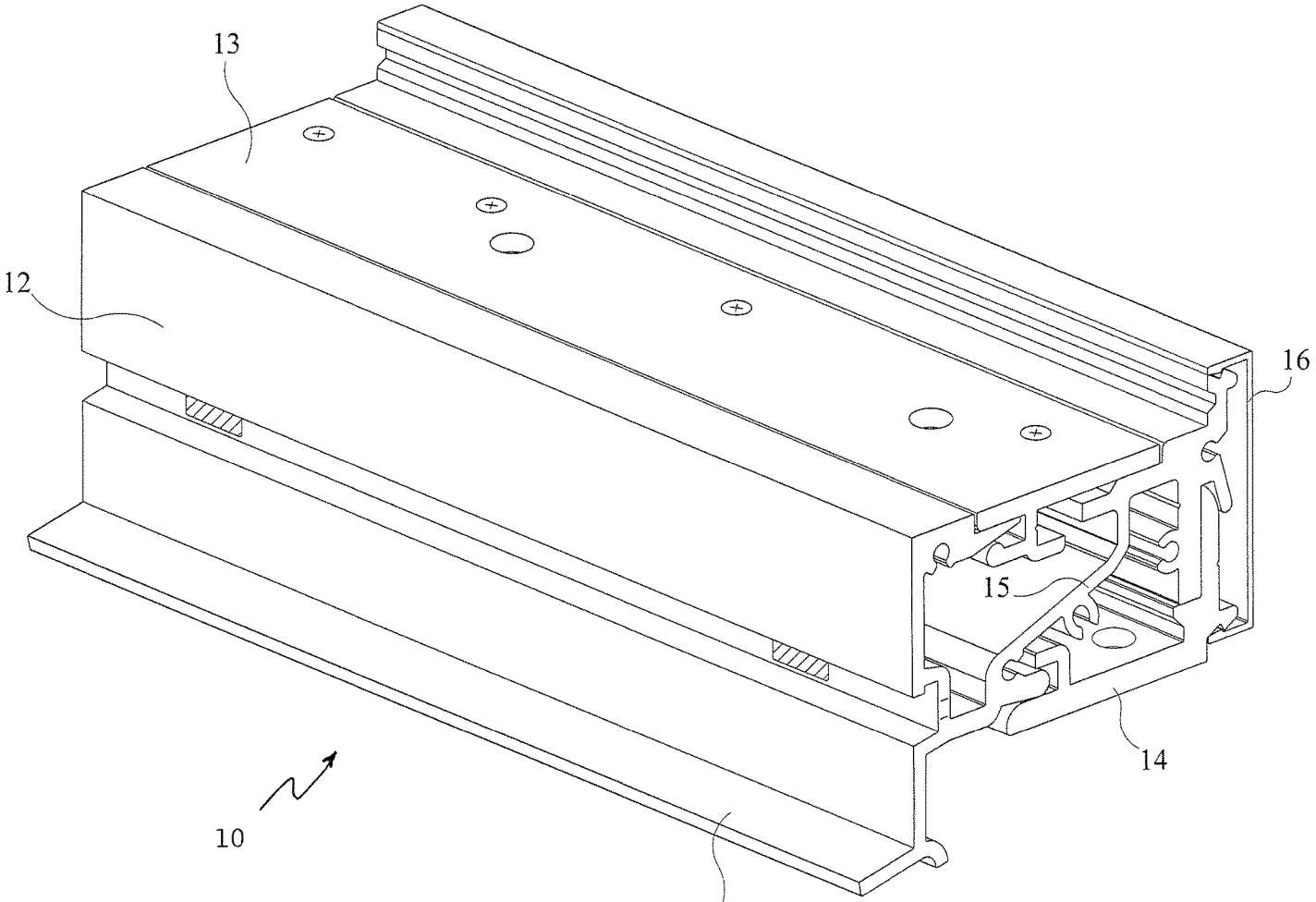
FIG. 6 shows an isometric sectional view of a shallow version of the window sub-sill system.
Figure 7:
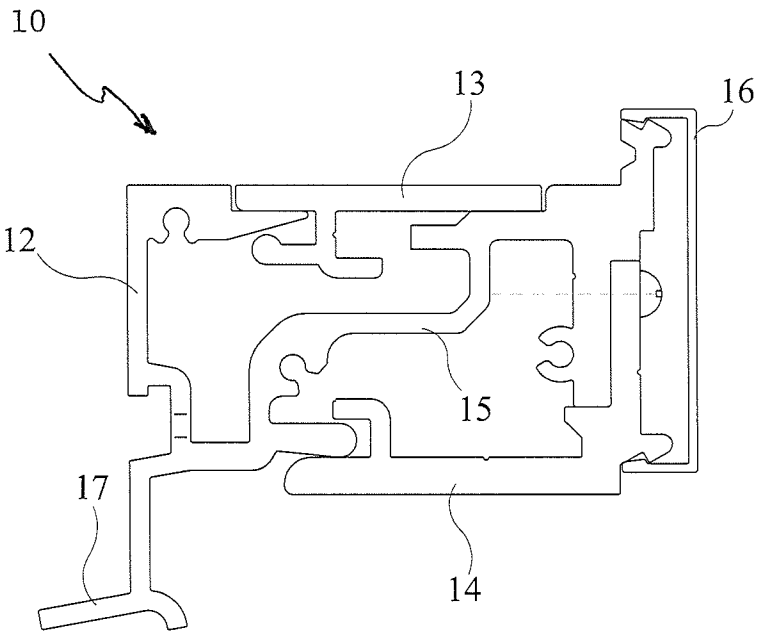
FIG. 7 shows a side sectional view of the shallow version of the window sub-sill system

FIG. 6 shows an isometric sectional view and FIG. 7 shows a side sectional view of a shallower version of the bottom sub-sill unit 10 of the window sub-sill system, with its parts being otherwise similar to those shown and described with respect to FIGS. 1-4. The shallow version has a shorter depth that may be used for a shallower window frame.

Figure 8:
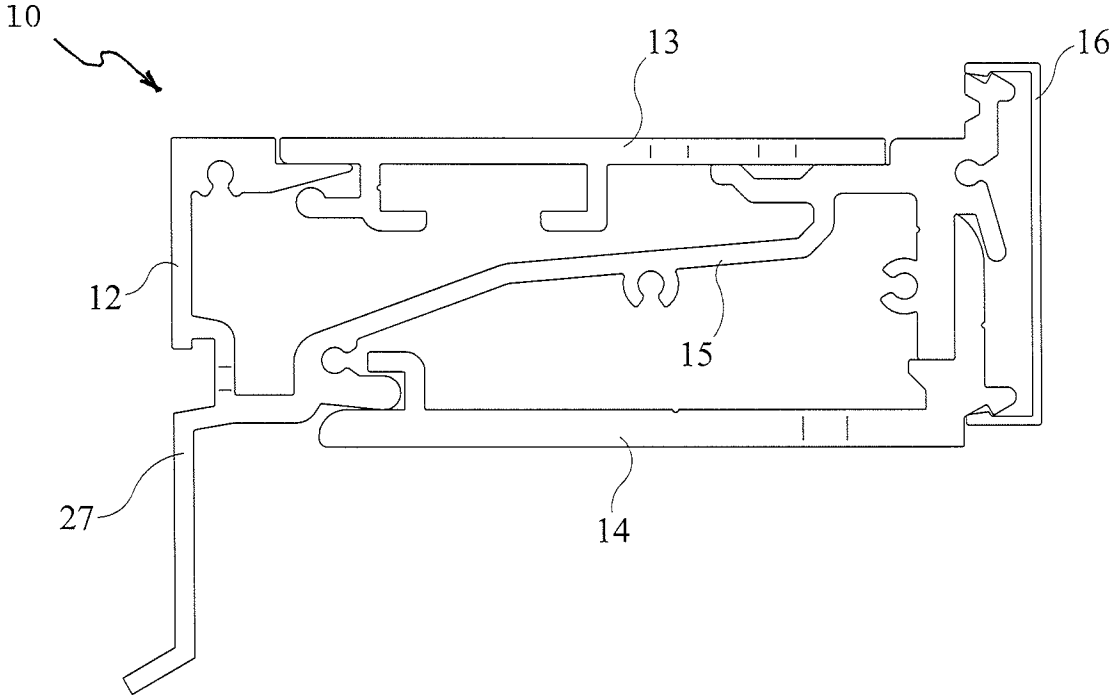
FIG. 8 shows a side sectional view of another version of the window sub-sill system having an extended lower rain flashing.

FIG. 8 shows a side sectional view of another version of the bottom sub-sill unit 10 of the window sub-sill system having an extended lower rain flashing 27, but with its parts being otherwise similar to those shown and described with respect to FIGS. 1-4.

Figure 9:
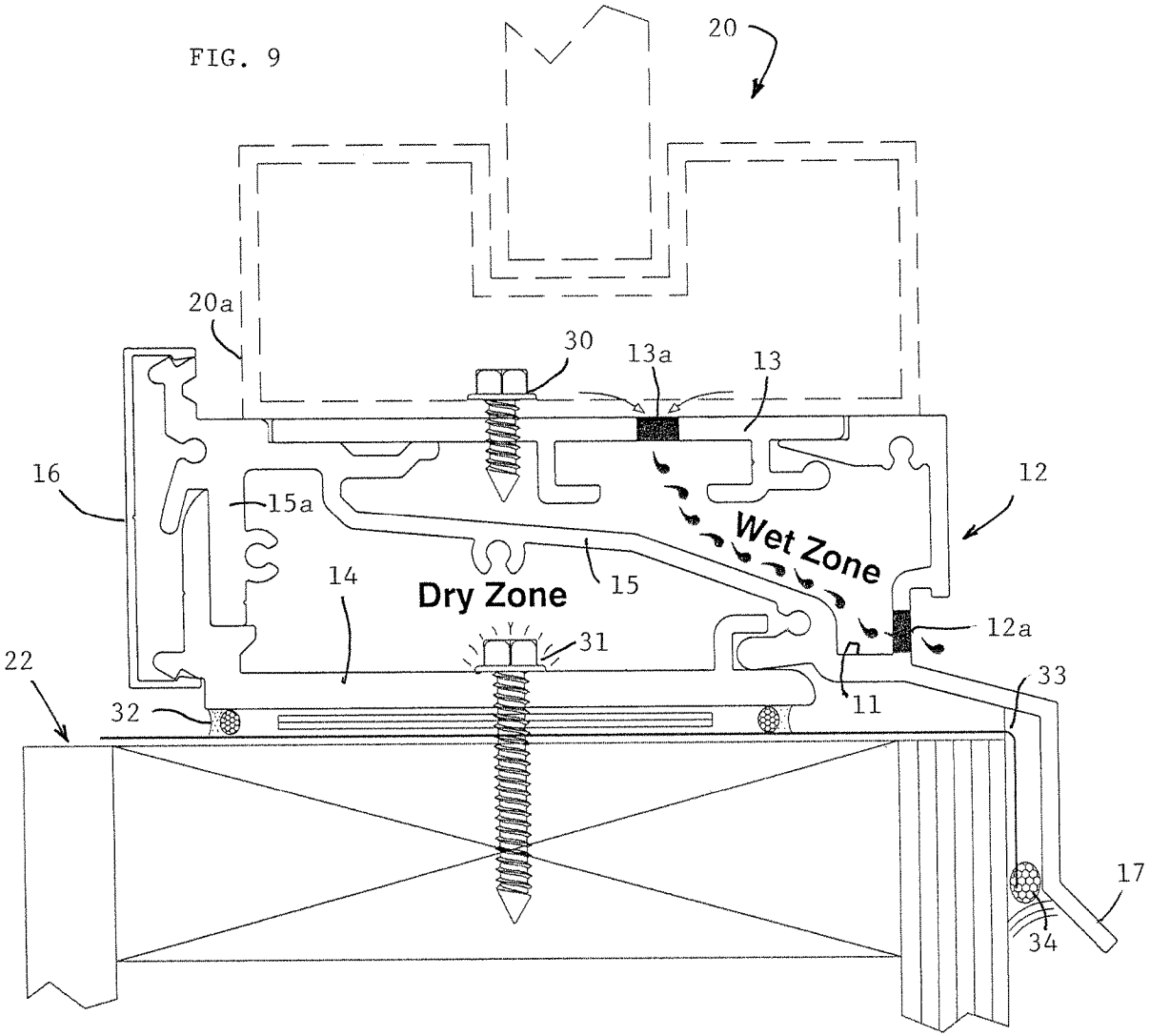
FIG. 9 is a sectional view showing the mounting of a bottom sub-sill unit below a window unit within a window frame for the window sub-sill system.

In the sectional view of FIG. 9, the bottom sub-sill unit 10 is illustrated mounted below a bottom part 20*a* of a window unit 20 on top of an upper surface of a bottom frame part 22 of a window frame to form a window sill system. A top fastener 30 such as a stainless steel screw may be used to form an attachment for the bottom part 20*a* of the window unit 20 to the top plate 13 of the bottom sub-sill unit 10. The window unit 20 (in dashed line) may be any of a variety of commercially available windows. The window unit 20 is placed on the bottom sub-sill unit 10 for improved water drainage of rainwater and other moisture beading down the window unit into drain holes 13*a* into water trough or channel 11 forming a Wet Zone. Moisture channeled down by the inner deflection wall 15 in the Wet Zone exits through weep holes 12*a* formed at a bottom corner of the front edge 12 of the bottom sub-sill unit 10. The lip 17 at the end of the front edge 12 directs the moisture flow outwardly and away from the front edge of the bottom frame part 22.

The base plate 14 of the bottom sub-sill unit 10 may be attached to the bottom frame part 22 of the window frame by a bottom fastener 31 such as a stainless steel lag bolt. The window frame is typically 2'×6' wood framing (also known as a "rough opening") as commonly used in residential construction. There are many other types of window that may be adapted. In the case of a concrete window frame, a stainless steel threaded rod set in epoxy adhesive with a nut and washer may be used. Plastic shims 32 may be placed between the base plate 14 and the bottom frame part 22 around each bottom fastener 31 to ensure that the base plate is installed level. They are a commodity item commonly used in the construction industry. The inner deflection wall 15 of the bottom sub-sill unit 10 deflects moisture into the wet zone and maintains a Dry Zone where the fasteners 31 are installed. The heads of the base plate fasteners may be covered with sealant even though they will not be exposed to moisture in the Dry Zone.

A sealant membrane 33 is commonly used in the construction industry to be applied to the bottom frame (and all around window frame) when a window unit is being installed. The waterproof, peel-and-stick membrane that is typically used is a commodity item that comes in rolls. A backer rod 34 with sealant is also commonly used to form a termination edge. The inner deflection wall 15 incorporating the inner extension 15*a* and outer front edge 12 snap-fits onto the base plate 14. The inner extension 15*a* provides a mounting for the end cap 16 forming an interior cover for the bottom sub-sill unit 10.

Figure 10A:
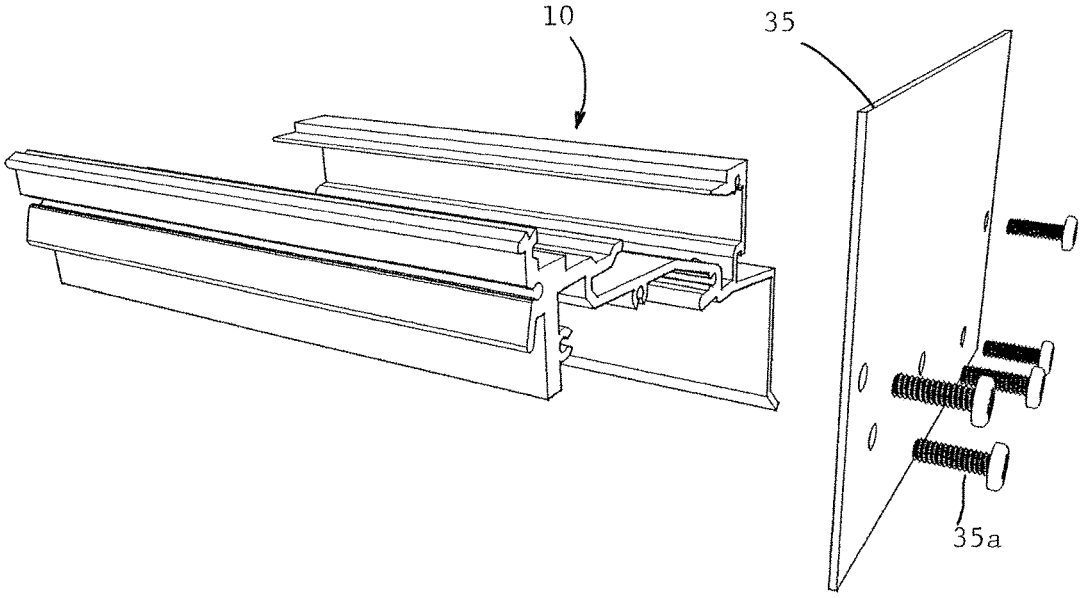
FIGS. 10A-10E are views illustrating an installation sequence for the components of the window sub-sill.
Figure 10B:
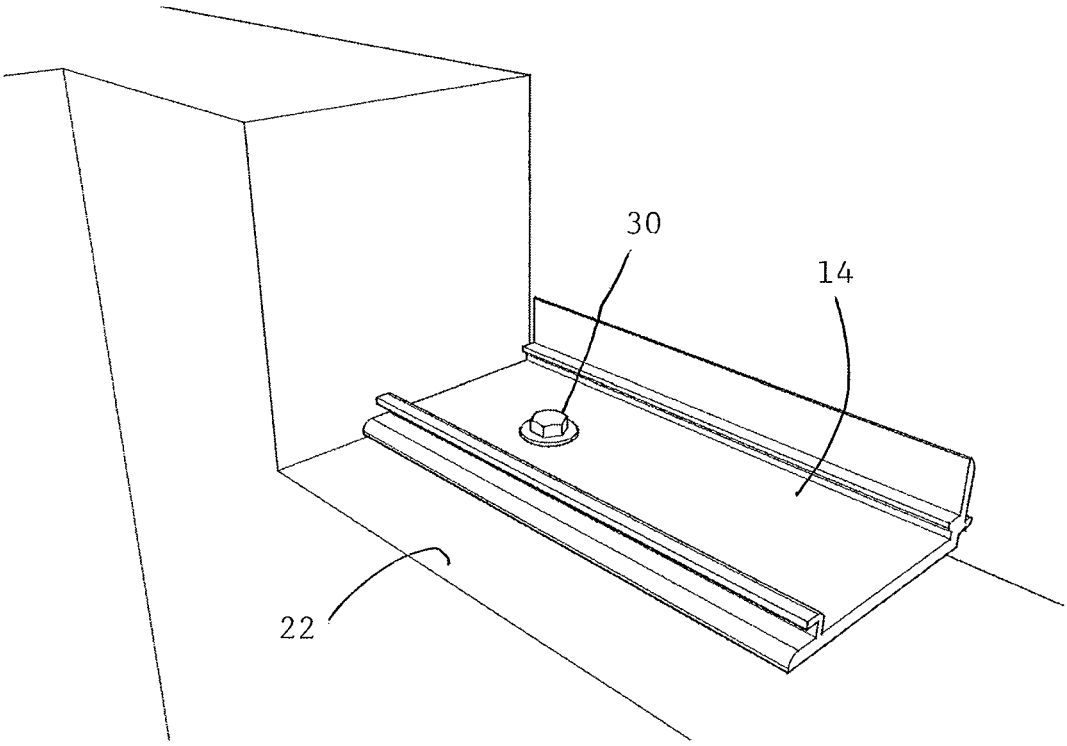
Figure 10C:
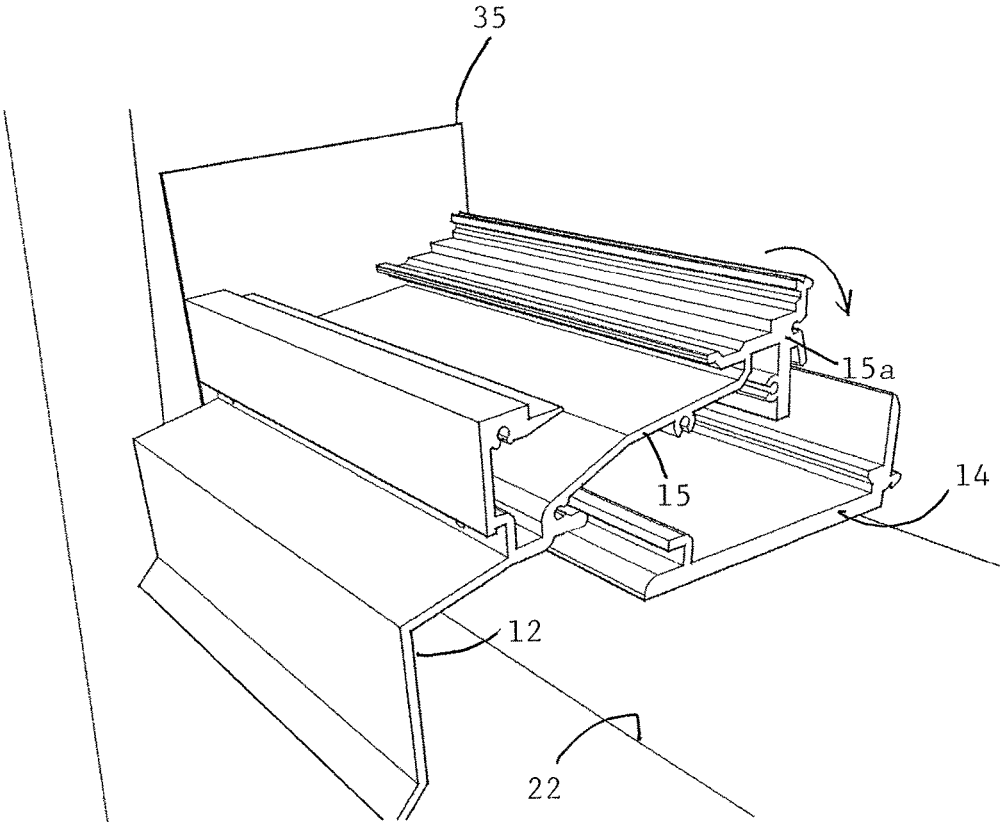
Figure 10D:
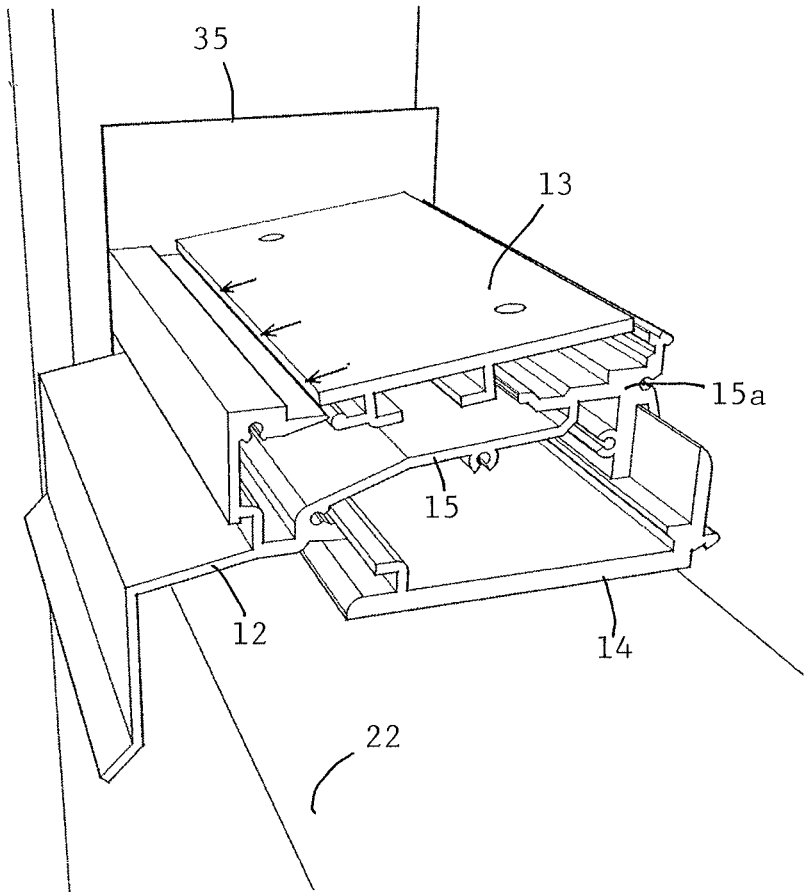
Figure 10E:
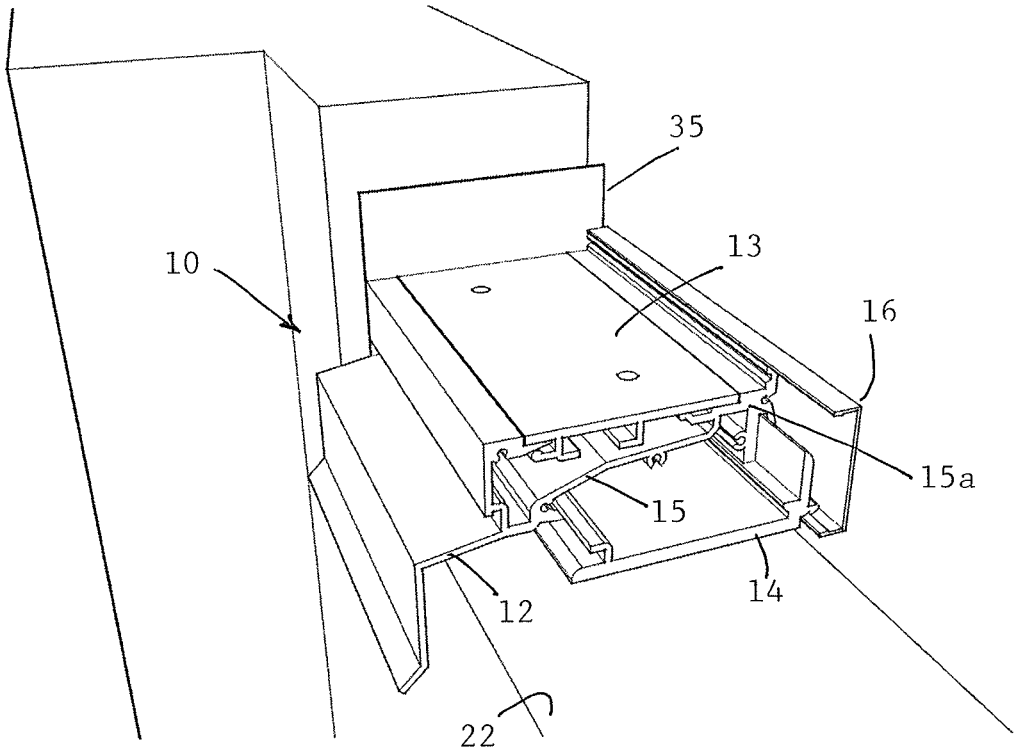

FIGS. 10A-10E are views illustrating an installation sequence for the bottom sub-sill unit for forming a window sub-sill system. In FIG. 10A, a bottom sub-sill unit 10, which is stocked with base plate, inner deflection wall, front edge and top plate together in standard over-length sizes, is cut at an assembly shop to a length that may be ⅝" less than the linear width of the window frame in which a window unit is to be installed to allow space for end dams 35 for covering the cut ends of the bottom sub-sill unit. The cut bottom sub-sill unit may be delivered from the assembly shop to a job site with its components snap-fitted together and cut ends covered by the end dams 35 fastened by screws 35*a* into pre-formed threaded holes in the bottom sub-sill unit parts. At the job site, the bottom sub-sill unit parts are taken apart, and the base plate 14 is fastened to the bottom frame part 22 with a fastener 30 on a plastic shim (not visible) for leveling the base plate, as shown in FIG. 10B. In FIG. 10C, the part that incorporates the inner deflection wall 15, inner extension 15*a*, and outer front edge 12 (together referred to as the "drainage plane") is tipped into place (with end dam 35 shown on one side) and snap-fitted on the base plate 14. In FIG. 10D, the top plate 13 is tipped into place onto the drainage plane. In FIG. 10E, the installation of the bottom sub-sill unit 10 on the bottom frame part 22 of the window frame is completed. The interior cap cover 16 is snapped on. The bottom sub-sill unit 10 is now ready for mounting of the bottom part of a window unit to the upper surface of the top plate 13.

It is to be understood that many modifications and variations may be devised given the above description of the general principles of the invention. It is intended that all such modifications and variations be considered as within the spirit and scope of this invention, as defined in the following claims.

What is claimed is:

1. A modular sub-sill system comprising:

a top plate attachable to a bottom part of a frame and spanning a width of an opening in an exterior wall of a building, wherein a first portion of the exterior wall of the building corresponds to a bottom part of the opening, wherein the top plate is mountable in the opening and forms a first horizontal surface between the bottom part of the frame and the first portion of the exterior wall, and wherein the top plate includes a plurality of weep holes that allow moisture on the first horizontal surface to pass through the top plate and deposit on an inner deflection wall below the top plate, wherein the inner deflection wall spans the width of the top plate and forms an oblique surface between the top plate and a base plate that spans the width of the top plate, and wherein the oblique surface channels the moisture into a plurality of exit holes in an outer front edge of the modular sub-sill system, and wherein the base plate forms a second horizontal surface below the inner deflection wall, spans the width of the top plate, and is attachable to the first portion of the exterior wall using a plurality of fasteners, and wherein the inner deflection wall and the plurality of exit holes are configured to prevent the moisture from reaching the fasteners.

2. The modular sub-sill system of claim 1, wherein the frame is a door frame, window frame, or skylight frame.

3. The modular sub-sill system of claim 1, wherein the frame is constructed from one or more of wood, aluminum, steel, concrete, plastic, rubber, synthetic materials, or sheet metal.

4. The modular sub-sill system of claim 1, wherein the modular sub-sill system is constructed from one or more of wood, aluminum, steel, concrete, plastic, rubber, synthetic materials, or sheet metal.

5. The modular sub-sill system of claim 1, wherein at least a portion of the inner deflection wall forms a trough at the outer front edge of the modular sub-sill system.

6. The modular sub-sill system of claim 5 further comprising one or more baffle sponges sized to fit in the trough.

7. A modular sub-sill system comprising:

a top plate that is attachable to a sill, spans at least a width of the sill, forms a first horizontal surface below the sill, and includes a plurality of weep holes arranged on the top plate to allow liquid deposited on the first horizontal surface to pass through the top plate and deposit on an inner deflection wall below the top plate, wherein the inner deflection wall spans at least the width of the top plate, forms an oblique surface between the top plate and a base plate, and channels the liquid into a plurality of exit holes in an outer front edge of the modular sub-sill system, wherein the base plate forms a second horizontal surface below the inner deflection wall, spans the width of the top plate, and is attachable to a portion of an exterior wall of a building that corresponds to a bottom part of an opening using a plurality of fasteners, and wherein the inner deflection wall and the plurality of exit holes are configured to prevent the liquid from reaching the fasteners.

8. The modular sub-sill system of claim 7, wherein the sill is a door sill, window sill, or skylight sill.

9. The modular sub-sill system of claim 7, wherein the plurality of fasteners include one or more of a screw, bolt, nail, or threaded rod.

10. The modular sub-sill system of claim 7, wherein at least one exit hole of the plurality of exit holes includes at least one of an eyebrow or set-back feature.

11. The modular sub-sill system of claim 7 further comprising one or more hooks on an underside of the top plate, wherein the one or more hooks are configured to hold a horizontal bar beneath the top plate.

12. The modular sub-sill system of claim 11, wherein the one or more hooks enable attaching the sill to the horizontal bar using one or more fasteners.

13. A modular sub-sill system comprising:

a top plate that forms a first horizontal surface;

an inner deflection wall, wherein the inner deflection wall forms an oblique surface below the top plate, wherein a width of the top plate plus a width of one or more end dams spans a width of an opening in an exterior wall of a building, wherein the inner deflection wall spans the width of the top plate, and wherein the inner deflection wall channels moisture that passes through the top plate and deposits on the oblique surface into a plurality of exit holes at an outer front edge of the modular sub-sill system; and a base plate, wherein the base plate forms a second horizontal surface below the inner deflection wall, spans the width of the top plate, and is attachable to a portion of the exterior wall of the building that corresponds to a bottom part of the opening using a plurality of fasteners, wherein the inner deflection wall and the plurality of exit holes prevent the moisture from reaching the fasteners.

14. The modular sub-sill system of claim 13, wherein the opening in the exterior wall of the building corresponds to a door, window, skylight, storefront, curtain wall, jalousie, or louver.

15. The modular sub-sill system of claim 13, wherein a depth of the modular sub-sill system corresponds to a depth of the opening in the exterior wall of the building.

16. The modular sub-sill system of claim 13, wherein at least one of the inner deflection wall, the top plate, or the base plate includes an internal splice sleeve.

17. The modular sub-sill system of claim 13, wherein the moisture that passes through the top plate passes through a plurality of weep holes in the top plate.

18. The modular sub-sill system of claim 17, wherein the plurality of weep holes are drilled through the top plate.

* * * * *